US007528330B2

(12) United States Patent
Behrens

(10) Patent No.: US 7,528,330 B2
(45) Date of Patent: May 5, 2009

(54) DEVICE FOR CONTROLLING VEHICLE ELECTRONICS

(75) Inventor: Ralph Behrens, Schellerten (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 0 days.

(21) Appl. No.: 11/187,620

(22) Filed: Jul. 22, 2005

(65) Prior Publication Data

US 2006/0042915 A1 Mar. 2, 2006

(30) Foreign Application Priority Data

Jul. 22, 2004 (EP) ..... 04017259

(51) Int. Cl.
*H01H 13/00* (2006.01)

(52) U.S. Cl. ..... 200/5 R; 345/184

(58) Field of Classification Search ..... 200/4, 200/5 R, 6 A, 14, 17 R, 18, 329, 336, 341; 345/156, 184, 161
See application file for complete search history.

(56) References Cited

U.S. PATENT DOCUMENTS 4,306,131 A 12/1981 St. John
5,555,172 A * 9/1996 Potter ..... 345/25
6,067,447 A * 5/2000 Zucker ..... 455/69
6,154,201 A * 11/2000 Levin et al. ..... 345/184
6,515,242 B2 * 2/2003 Takatsuki ..... 200/6 A
6,541,716 B2 * 4/2003 Gotoh ..... 200/6 A
6,700,565 B2 * 3/2004 Niiyama ..... 200/5 A
2004/0032395 A1 2/2004 Goldenberg et al.

FOREIGN PATENT DOCUMENTS

EP 1 205 956 A2 5/2002

* cited by examiner

*Primary Examiner*—Elvin G Enad
*Assistant Examiner*—Marina Fishman
(74) *Attorney, Agent, or Firm*—Brinks Hofer Gilson & Lione

(57) ABSTRACT

A controller device having a rotary-push-button switch is arranged on a frame and the rotary-push-button switch is movable with respect to the frame between at least a first operating position and a second operating position. A position detecting element is used to determine whether the rotary-push-button switch is in the first or second positions. When the position detecting element indicates that the switch is in the first position, the rotary-push-button switch is operated in a first mode. Similarly, the rotary-push-button switch is operated in a second mode when the position detecting element indicates that the switch is in the second position.

17 Claims, 5 Drawing Sheets

DEVICE FOR CONTROLLING VEHICLE ELECTRONICS

BACKGROUND OF THE INVENTION

1. Priority Claim

This application claims priority of European Patent Application EP 04 017 259.5, filed on Jul. 22, 2004, which is incorporated herein by reference.

2. Technical Field

The present invention relates to a controller device for controlling an electronic system, particularly electronics included in a vehicle multimedia system.

3. Related Art

Over time, multimedia systems for vehicles have become popular. In addition to traditional audio components, these multimedia systems offer several new functions. Due to the increased number of functions and services offered by these multimedia systems, system handling may be complex, particularly with respect to the selection of services and functions by the user.

Some vehicle multimedia systems employ primary and secondary rotary-push-button switches to allow the user to select and activate a large number of functions and services. Rotation of the primary rotary-push-button may control the volume of the audio played by an audio component of the system while pushing the switch may control the on/off function for the audio component. By rotating the secondary switch, the user may move a cursor-like mark on a display of the system from one selection item to another. Once highlighted in this manner, the activation of a respective selection item may be accomplished by pushing the switch. Although these vehicle multimedia systems may operate well, there is a demand for a system with improved ergonomics.

SUMMARY

A controller device having a rotary-push-button switch is arranged on a frame and the rotary-push-button switch is movable with respect to the frame between at least a first operating position and a second operating position. A position detecting element is used to determine whether the rotary-push-button switch is in the first or second positions. When the position detecting element indicates that the switch is in the first position, the rotary-push-button switch is operated in a first mode. Similarly, the rotary-push-button switch is operated in a second mode when the position detecting element indicates that the switch is in the second position.

The rotary-push-button switch may be moved between the first operating position and second operating positions in a plane that is generally perpendicular to the rotation axis of the rotary-push-button switch. The position detecting element detects the position of the rotary-push-button switch in the plane. In response to the detected position, the switch is active in the first operating mode or the second operating mode. In the first operating mode, for example, the rotary-push-button switch may be used to control the volume of the audio components used in the vehicle multimedia system. In the second operating mode, for example, the same rotary-push-button switch may be used to select and activate functions and services, like Internet, E-mail, navigation, and the like.

The controller may also include a locking element for releasably holding the rotary-push-button switch in each of the first and the second position may be provided. The locking element may be a mechanical, spring based element, or in electro-mechanical element that generates the respective holding force electrically. For example, a mechanical locking element may be provided as a movable pin that is biased by a spring and engages with a respective counter element, e.g. a recess or a nose, mounted on the element to be hold.

The locking element holds the rotary-push-button switch in the respective operational position and assists in preventing unintended movement of the switch out of the desired position. Further, the locking element may provide a haptic indication to the user during movement of the rotary-push-button, for example by a click, that a particular one of the operational positions has been reached.

The controller device may assist in reducing the number of rotary-push-button switches and the like that may be otherwise needed to select and activate the many functions and services of a multimedia system. This reduction in the number of switches and the like, however, does not result in a more complex system. Rather, the ergonomics of the system are improved since the user is not forced to physically reach for and activate otherwise unnecessary rotary-push-button switches.

A vehicle multimedia system employing the controller is also contemplated. The vehicle multimedia device comprises a front panel unit that is adapted to be placed at the dashboard, a display disposed in the front panel unit, and a controller device of the type described above. The controller device may be placed remote of the front panel unit, such as in the middle and/or horizontal part of the dashboard between the front seats of the vehicle.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
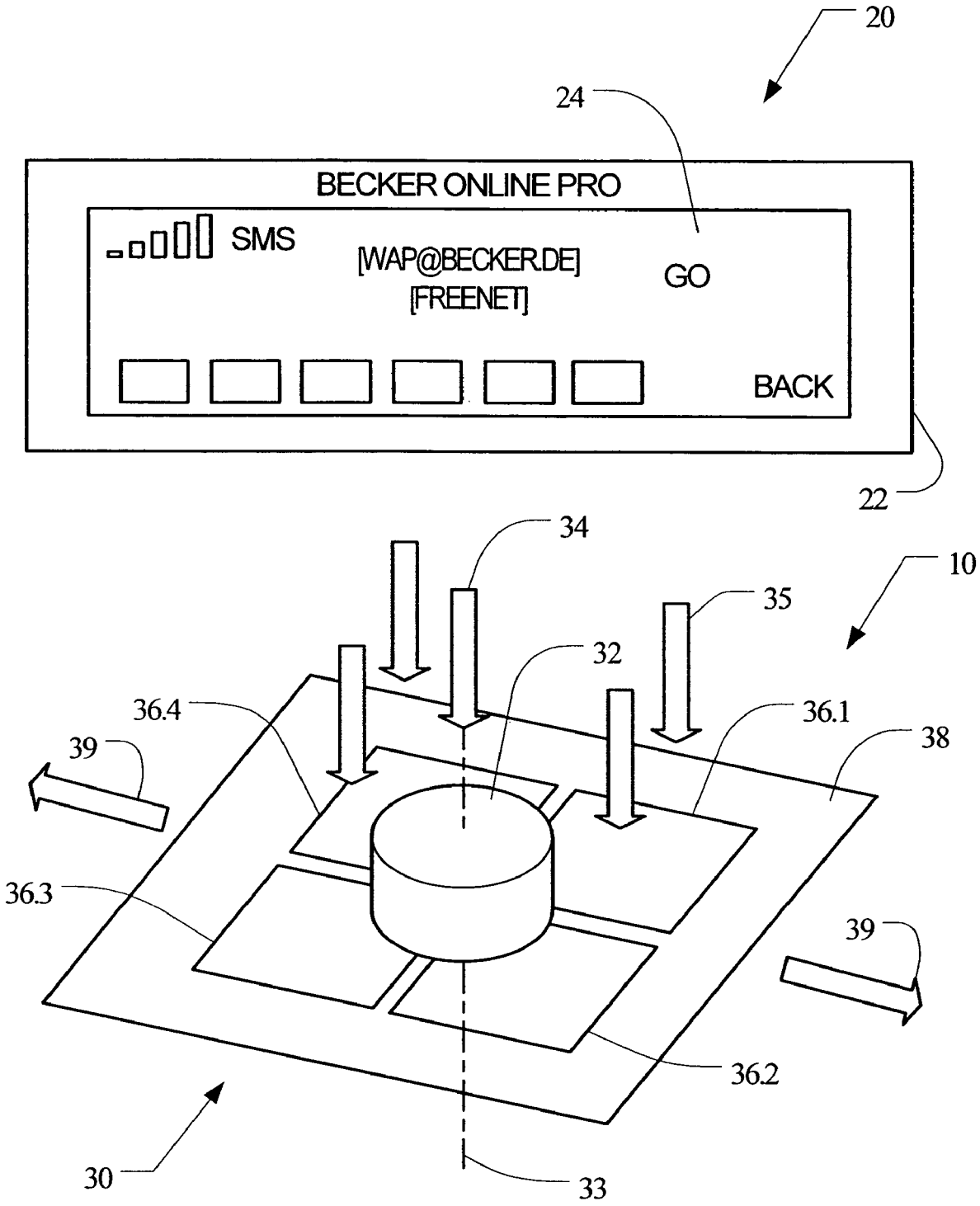
FIG. 1 is a schematic diagram of one implementation of a vehicle multimedia system employing a controller device.

In FIG. 1, a vehicle multimedia system is schematically shown and referenced generally at 10. It is to be noted that FIG. 1 shows only selected parts of the vehicle multimedia system for the sake of simplicity.

Generally, the vehicle multimedia system 10 comprises a number of different components or units that offer the user a range of functions and services. For example, the vehicle multimedia system may comprise a radio tuner unit for playing radio stations; a navigation unit for offering route guidance; a CD- and DVD-player for playing music or video disks; a GSM mobile unit for allowing telephone calls; and/or an Internet unit for offering a plurality of Internet services, such as E-mail and the like. This enumeration is not intended to be complete and, therefore, further units offering other functions or services may be provided. Similarly, a single multimedia system 10 may only include a small subset of these features.

The vehicle multimedia system 10 may include a front panel unit 20 having a front panel 22 with an integrated display 24, and a controller device 30. In the illustrated example, the size of the front panel unit 20 is adapted to the size of the receiving opening of the DIN ISO installation slot in the dashboard of a vehicle. The size of the display 24 may correspond to the size of the front panel 22. In this example, substantially the entire area of the front panel 22 is occupied by the display 24. The display 24 may be, for example, a dot matrix display. Information, such as selectable menu items, may be presented to the user on the display 24. The menu items correspond to functions and/or services offered by the vehicle multimedia system 10. The selection and activation of the menu items may be carried out through the controller device 30.

The controller device 30 may be placed within the vehicle at a position that is remote of the front panel unit 20, and may communicate with the components of the front panel unit 20 wirelessly. For example, communication may take place using the bluetooth protocol for the wireless data transmission between the controller device 30 and the front panel unit 20.

The controller device 30 comprises a rotary-push-button switch 32. The rotary-push-button switch 32 may offer at least two different functions, namely, a rotary function which may be activated by rotating it around a rotation axis 33, and a push switch function, which may be activated by pushing it in the direction of the rotation axis 33. An arrow 34 indicates the direction of this pushing movement.

Four push switches 36.1 through 36.4 may be symmetrically spaced around the rotary-push-button switch 32. In the illustrated example, the push switches 36 lie in a common plane that is generally perpendicular to the rotation axis 33. The push switches 36 may be activated by pushing them in a direction that is generally parallel to the rotation axis 33, as indicated by arrows 35.

The unit comprising the rotary-push-button switch 32 and the push switches 36 may be supported or mounted on a supporting plate 38, which is also oriented generally perpendicular to the rotation axis 33. In this configuration, the illustrated controller device 30 offers five push switches and one rotary switch in total.

The rotary-push-button switch 32, the push switches 36 and the supporting plate 38 may be arranged on a common frame so that they may be moved from a first operating position in which one or more of the rotational and push-button functions of the rotary-push-button switch 32 are operational to a second operating position in which one or more of the rotational and push-button functions of the rotary-push-button switch are likewise operational, and vice versa. The direction of this movement is indicated by arrows 39. The movement of the rotary-push-button switch 32 may take place laterally in a plane that is generally perpendicular to the rotation axis 33. For example, the movement may take place in a plane that is generally parallel to a plane containing the supporting plate 38.

The rotary-push-button switch 32 may remain in either the first operating position or the second operating position, respectively, once the user has moved it to the desired operating position. In other words, the rotary-push-button switch 32 and corresponding movable portions of controller device 30 need not automatically return to a main position or in initial position upon release of an activation force in the direction of arrows 39.

Figure 2:
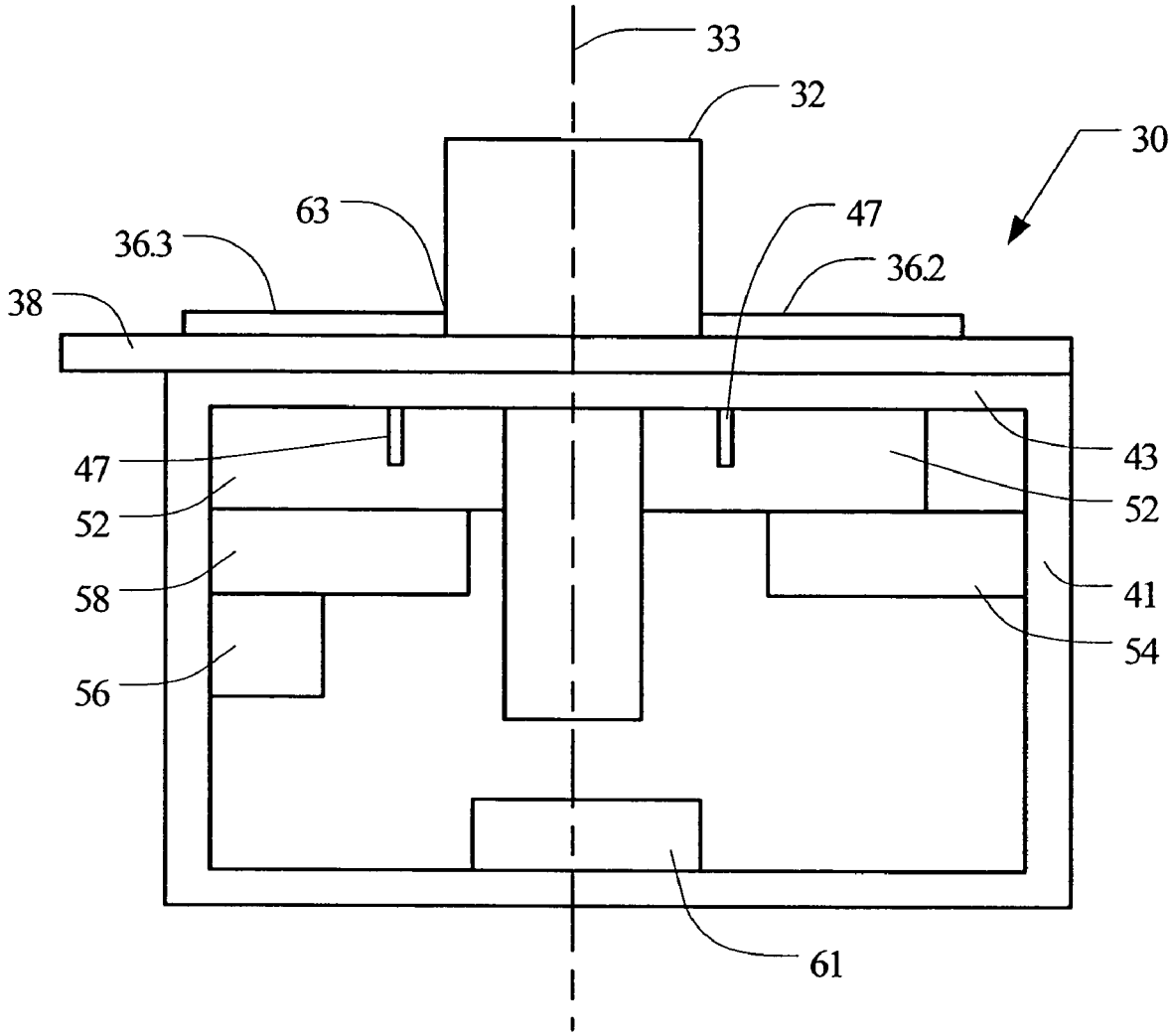
FIGS. 2 and 3 are sectional side views of the controller device of FIG. 1.
Figure 3:
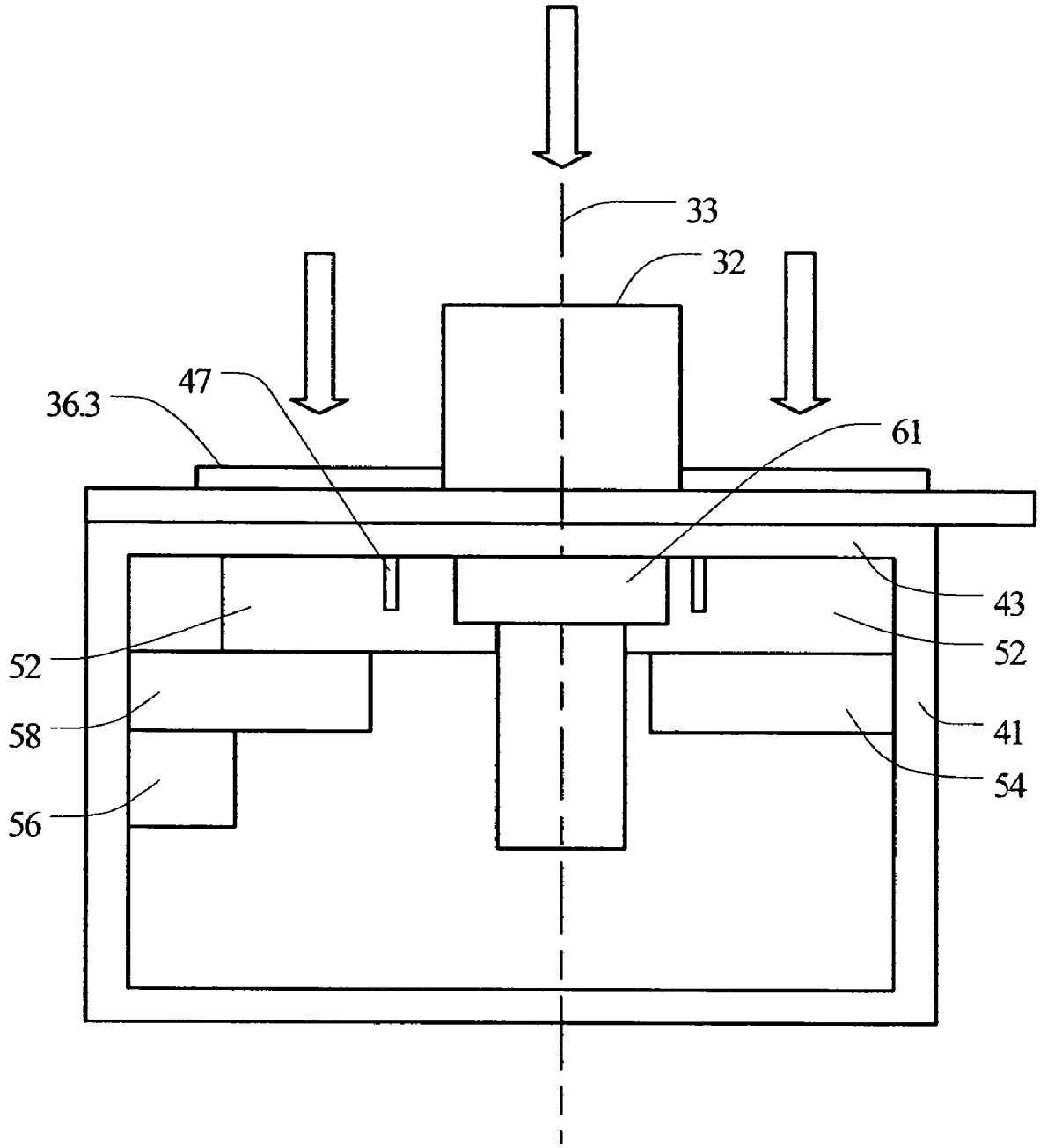

FIGS. 2 and 3 are schematic cross-sectional side views of the controller device 30 shown in FIG. 1. In these figures, the elements described in connection with FIG. 1 are referenced with the same reference numerals. As shown, the controller device 30 may include a frame 41 that serves as a support for supporting plate 38 as well as other components employed in the controller device. The frame 41 may comprise a plate 43 having an opening 45 for receiving portions of the switches 32, 36 into the frame interior. The plate 43 may be adapted to support and hold the supporting plate 38 while concurrently allowing bidirectional, horizontal movement of the supporting plate 38 in a plane that is generally parallel to the plate 43. FIGS. 2 and 3 show that the supporting plate 38 with the switches 32 and 36 may be moved to the left hand side and the right hand side.

Figure 4:
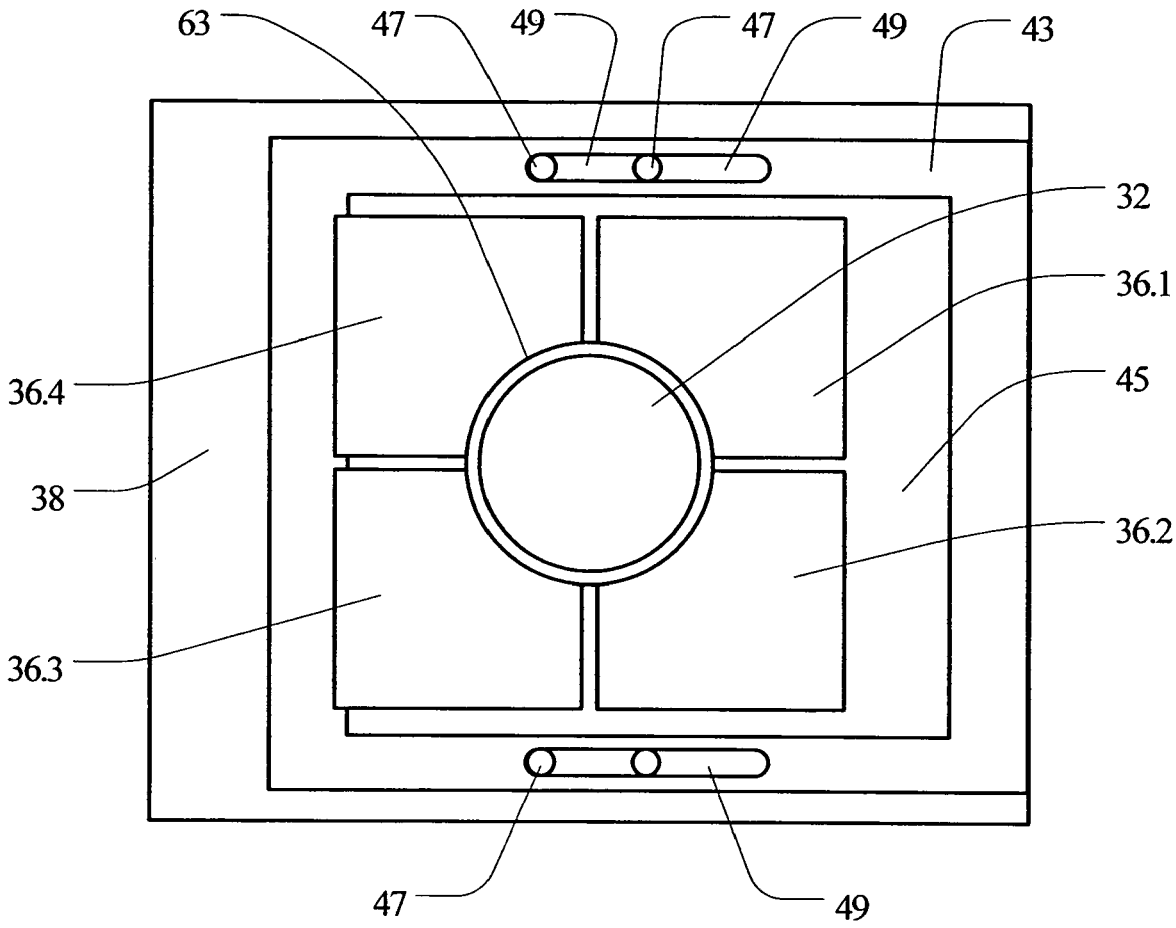
FIGS. 4 and 5 are schematic top views of the controller device of FIG. 1 in two different operational positions.
Figure 5:
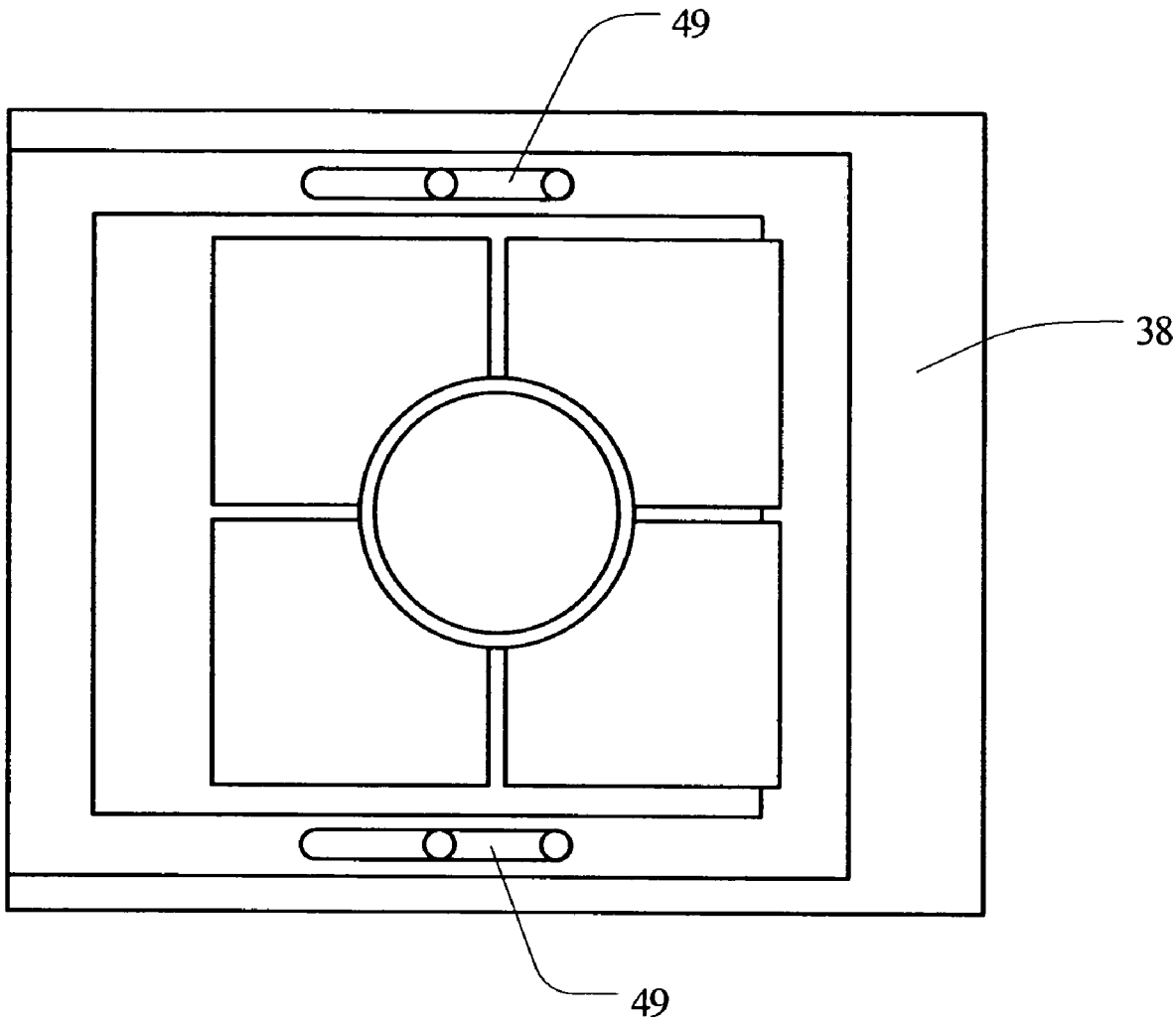

The supporting plate 38 may comprise guide pins 47 that are mounted on the underside of the supporting plate 38. The guide pins 47 extend through the plate 43 and are engaged by corresponding elongated holes 49. As shown in FIGS. 4 and 5, two elongated holes 49 may be provided on opposite portions of the plate 43. The elongated holes 49 may be adapted to channel the guide pins 47 along a restricted path between the first and second operating positions. Further, they may function as a mechanical stop to limit the range of movement of the supporting plate 38 in both directions. In FIGS. 2 and 4, the supporting plate 38 and corresponding components are shown in their leftmost position and in FIG. 3 and five in their rightmost position.

The interior space of the frame 41 may serve to house and/or support various electronic components. For example, electronic elements 52 may be provided to detect the switching of the rotary-push-button switch 32 as well as the push switches 36. As shown in the figures, the electronic elements 52 may be provided directly below the supporting plate 38 in contact with the respective switches. A position detection element 54 may be disposed adjacent the electronic elements 52. The position detection element 54 may be adapted to detect the position of the supporting plate 38 and, as a consequence, the position of the rotary-push-button switch 32. To this end, the position detection element 54 may be a sensor or switch of the type that detects the arrival of the rotary-push-button switch 32 at the first and second operating positions, respectively. The position detection element 54 may generate a position detection signal that may be transmitted to the front panel unit 20 of the vehicle multimedia system.

The controller device 30 may also comprise a transmitter element 56, which likewise may be disposed at the interior of the frame 41. The transmitter element 56 may be used to transmit control signals from the position detection element 54 as well as from all of the electronics corresponding to switches 32, 36. The transmitter 56 receives the control signals from the position detection element 54 and the switching electronic element 52 and, for example, uses the bluetooth protocol for wirelessly transmitting these control signals to one or more corresponding receiver components disposed in the front panel unit 20. Alternatively, bi-directional communication between the front panel unit 20 and the controller device 30 may be achieved by employing transceiver units in the front panel unit 20 and the controller device 30.

The controller device 30 also may comprise a locking element 58 that releasably locks the supporting plate 38 and corresponding switches 32, 36 in the first and second operating positions, respectively. The locking element 58 employed in the illustrated examples operates on a mechanical basis. It may be used to hold the supporting plate 38 in either the first or second operating positions, respectively, as selected by the user. Once the supporting plate 38 and corresponding components are in one of the operating positions, the locking element 58 secures the supporting plate 38 and corresponding components in the selected operating position. In response to the application of a predetermined force on the supporting plate 38 or the rotary-push-button switch 32 in the direction of the opposite operating position, the locking element 58 releases the locking engagement between the frame and the supporting plate 38 and allows the user to move the supporting plate 38 and corresponding components to the opposite operating position. Once the supporting plate 38 and corresponding components are in the opposite operating position, the locking element 58 again secures the plate 38 and corresponding components from further spurious, unintended movement. For example, when the controller device 30 is employed as a component in a vehicle multimedia system, the locking force may be selected so that the supporting plate 38 does not leave its position in response to any acceleration forces or vibrations that are imparted to the controller device 30 as result of the natural motion of the vehicle. Rather, the locking force used by locking element 58 may be sufficient to ensure that the supporting plate 38 leaves the operating position only in response to manual activation by the user.

The controller device 30 may also comprise a light source 61 that emits light in the direction of the supporting plate 38. The light source 61 may be positioned proximate the bottom of the frame 41, as shown in FIG. 2, as well as at other places within the frame 41. In FIG. 3, the light source 61 is shown adjacent the plate 43 and not at the bottom of the frame 41. For example, the light source 61 may be positioned so that the emitted light passes through the opening 45 of the frame 41 and into the regions 63 between the several switches 32, 36.

The light source 61 may comprise two differently colored light sources. For example, the light source 61 may include a source for red light and a source for green light. Dependent on the operating position of the supporting plate 38 and corresponding components, the light source 61 emits red light or green light. As a result, the user may recognize the position of the supporting plate 38 (and, as such, the operating mode of the switches) via the color of the light.

Top views of the controller device 30 are shown in FIGS. 4 and 5. In FIG. 4, the supporting plate 38 and corresponding switches 32 and 36 are in the first operating position, whereas the supporting plate 38 and corresponding switches 32 and 36 are shown in the second operating position in FIG. 5. In both figures, the guide pins 47 are shown engaged by elongated holes 49 which are provided in the plate 43 of the frame 41. Further, the guide pins 47 of this example abut against the left end of the elongated holes 49 in the first operating position, and abut against the right end of the elongated holes in the second operating position. FIGS. 4 and 5 also show the gap 63 between the switches 32 and 36 through which light emitted from lighting element 61 passes from the interior space of the frame to the outside.

As already mentioned with reference to FIG. 1, the controller device 30 may be used for controlling a vehicle multimedia system 10. However, the controller device 30 may also be used for controlling other electronic devices in the vehicle. For example, the controller device 30 may be used to control basic vehicle radio devices, or even electronic systems beyond the automotive field.

In the exemplary controller device 30, the supporting plate 38 and, therefore, the rotary-push-button switch 32 and the four switches 36.1 to 36.4 may be moved from a first operating position to a second operating position and vice versa. This movement between the two positions is used to switch between a first operating mode assigned to the first operating position and a second operating mode assigned to the second operating position. By employing two operating modes, the rotary-push-button switch 32 and the four switches 36 may accomplish the same functionality as two separate switching units having the same number of switches. For example, the rotary-push-button switch 32 may be used for controlling the volume of the vehicle's audio unit when the first operating mode is active, and for moving a cursor to highlight menu items on the display 24 when the second switching mode is activated. The user may easily toggle between either operating mode merely by moving the rotary-push-button switch 32 and switches 36 from the first operating position to the second operating position and vice versa.

In another example, the rotary-push-button switch 32 may be used to control the volume (rotating clockwise or counterclockwise) and for switching the system on and off by pushing the switch when in the first switching mode (supporting plate and corresponding components in the first operating position). In this first operating mode, the switches 36.1 to 36.4 may be used to activate a telephone function, a navigation function, a CD/DVD function and a tuner function, respectively.

In the second operating mode (supporting plate 38 and corresponding components in the second operating position), the rotary-push-button switch 32 may be used to highlight menu items presented on display 24 by rotating the switch. Activation of a highlighted item may be achieved by pushing the switch 32. In this second operating mode, the switches 36.1 to 36.4 may be used as a back key, CD/DVD eject key, a first soft key and a second soft key, respectively. It is to be noted that this assignment of functions to the switches is just one possibility. There are many other possible assignments.

The controller device 30 provides simple, ergonomic control of an electronic system, such as a vehicle multimedia system. By employing the controller unit 30 in the foregoing manner, the number of rotary-push-button controllers and other switches used to control increasingly complex electronic systems may be reduced. The user may move the switches of the controller unit from one operating position to another operating position with the result of switching between multiple operating modes for the switches.

Although the exemplary construction shown in the figures employs a supporting plate 38 for supporting the rotary-push-button switch 32 and the push switches 36, the supporting plate 38 may be replaced by any construction in which the rotary-push-button switch 32 and, optionally, switches 36 are moved between multiple operating positions. Similarly, the push switches 36 are optional components and merely serve to enhance the overall operation of the controller device 30. To this end, the controller device 30 may comprise only a single rotary-push-button switch 36 without the further push switches 36 shown in the illustrated examples.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. A system for controlling a multimedia device disposed in a vehicle, the system comprising:

a front panel unit adapted for mounting proximate the dashboard of the vehicle, where the front panel unit comprises a display that provides visual indicia corresponding to user selectable functions of the multimedia device;

a controller in electronic communication with the front panel unit, the controller comprising a frame, a supporting plate supported by the frame and that is configured to move linearly with respect to the frame between at least first and second operational positions, a rotary-push-button switch fixed for co-movement with the supporting plate, at least one push switch disposed proximate the rotary-push-button switch and fixed for co-movement with the supporting plate, a position detecting element disposed to detect the operating position of the supporting plate, and a light element positioned within the frame and assigned to cooperate with the position detecting element, the light element configured to emit lighting characteristics and vary the lighting characteristics in response to the operating position of the supporting plate, where manipulation of the rotary-push-button switch is associated with a first mode by the front panel unit when the position detecting element detects that the supporting plate is in the first operating position, and at least two guide pins projecting from the supporting plate;

where manipulation of the rotary-push-button switch is associated with a second mode by the front panel unit when the position detecting element detects that the supporting plate is in the second operating position; and where the frame comprises at least two holes that receive the at least two guide pins and where the at least two holes restrict movement of the supporting plate.

2. The system of claim 1, where the controller is placed remote of the front panel unit within the vehicle.

3. The system of claim 1, and further comprising a locking element for releasably holding the supporting plate in either the first operating position or the second operating position.

4. The system of claim 1, where the controller comprises a plurality of push switches that are disposed symmetrically about the rotary-push-button switch and that are fixed for co-movement with the supporting plate.

5. The system of claim 1, where the supporting plate and frame comprises a cooperating guide assembly disposed to limit the movement of the supporting plate between the first operating position in the second operating position.

6. A controller for interfacing a user with an electronic system, the controller comprising:

a frame;

a supporting plate engaged for sliding movement with respect to the frame between at least first and second operational positions;

a rotary-push-button switch fixed for co-movement with the supporting plate;

a position detecting element disposed to directly detect the operating position of the supporting plate, where manipulation of the rotary-push-button switch is associated with a first mode when the position detecting element detects that the supporting plate is in the first operating position, and where manipulation of the rotary-push-button switch is associated with a second mode when the position detecting element detects that the supporting plate is in the second operating position; and a locking element that releasably holds the supporting plate in the first operating position or the second operating position;

at least two guide pins projecting from opposite ends of an underside of the supporting plate, where the frame comprises at least two elongated holes that receive the at least two guide pins and where the at least two elongated holes restrict movement of the supporting plate.

7. The controller of claim 6 further comprising a plurality of push switches symmetrically disposed about the rotary-push-button switch.

8. The controller of claim 7 where the push switches are fixed for co-movement with the supporting plate.

9. The controller of claim 6 further comprising a lighting element assigned to cooperate with the position detecting element and where the characteristics of the lighting element vary with the position detected by the position detecting element.

10. The controller of claim 6 where the supporting plate is configured to move linearly with respect to the frame.

11. The controller of claim 6 further comprising a transmitter that transmits a signal generated in response to the manipulation of the rotary-push-button switch.

12. The controller of claim 11 where the transmitter comprises a wireless transmitter element for wirelessly transmitting the signal.

13. The controller of claim 11 where the transmitter comprises a wire-bound transmitter element for transmitting the signal via a wire.

14. The controller of claim 6 further comprising a transmitter that transmits a signal generated by the position detecting, where the signal identifies the operational position of the supporting plate.

15. The controller of claim 14 where the transmitter comprises a wireless transmitter element for wirelessly transmitting the signal.

16. The controller of claim 14 where the transmitter comprises a wire-bound transmitter element for transmitting the signal via a wire.

17. The controller of claim 6 where the locking element comprises an electromechanical locking element.

* * * * *